US005967613A

United States Patent [19]

McKeever

[11] Patent Number: 5,967,613

[45] Date of Patent: Oct. 19, 1999

[54] WHEELCHAIR SUPPORT AND ATTACHMENT SYSTEM

[75] Inventor: Michael David McKeever, Grygla, Minn.

[73] Assignee: Piccard Corporation, Weyerhaeuser, Wis.

[21] Appl. No.: 08/909,180

[22] Filed: Aug. 11, 1997

[51] Int. Cl.[6] ..... A47C 7/36

[52] U.S. Cl. ..... 297/397; 297/406

[58] Field of Search ..... 297/397, 406, 297/407, 410, 486, 188.06, 391

[56] References Cited

U.S. PATENT DOCUMENTS

| | | | |
|---|---|---|---|
| 0,969,251 | 9/1910 | Denzer . | |
| 2,306,334 | 12/1942 | Costas | 297/407 |
| 2,666,476 | 1/1954 | Lycan | 297/410 |
| 3,188,079 | 6/1965 | Boetcker et al. | 297/391 X |
| 3,337,628 | 8/1967 | Belk | 297/397 |
| 3,497,259 | 2/1970 | Sherfey | 297/391 |
| 3,730,589 | 5/1973 | Lane | 297/391 |
| 4,073,537 | 2/1978 | Hammersburg | 297/384 |
| 4,874,203 | 10/1989 | Henley | 297/250 |
| 4,989,836 | 2/1991 | Hudson, III et al. | 297/391 |
| 5,074,574 | 12/1991 | Carwin | 280/304.1 |
| 5,076,264 | 12/1991 | Lonardo et al. | 128/869 |
| 5,123,699 | 6/1992 | Warburton | 297/219 |
| 5,308,028 | 5/1994 | Kornberg | 248/118 |
| 5,447,356 | 9/1995 | Snijders | 297/284.3 |
| 5,586,810 | 12/1996 | Liu | 297/406 |

*Primary Examiner*—Peter M. Cuomo
*Assistant Examiner*—Stephen Vu
*Attorney, Agent, or Firm*—Curtis V. Harr

[57] ABSTRACT

A fully adjustable upper torso and head support positioning system that retro fits to nearly any standard wheelchair is provided. This system has two individually adjustable lateral pads to provide comfortable yet positive adjustable support to fit the unique contours of a wide variety of users. An integrated head support adjusts vertically to an individual's height and adjusts horizontally to accommodate a moderate to severe Kyphosus. The head and shoulder support adjustments facilitate the present invention's use for patients with varying heights and shoulder widths. The aforementioned head and shoulder supports are attached to a mounting bracket which is designed in a manner that facilitates its easy attachment to the varying designs of wheelchairs currently used today.

8 Claims, 4 Drawing Sheets

13
12
14
15
10
30
16
18
42
54
30
20
24
42
38
38
32
34
26
28
36
40
36
44
34
32

WHEELCHAIR SUPPORT AND ATTACHMENT SYSTEM

BACKGROUND OF THE INVENTION

The use of wheelchairs for mentally or physically impaired patients has become commonplace. Wheelchairs provide mobility for patients, and in the case of patients with some use of their extremities, provide needed support for their body while allowing the patient to perform certain daily tasks without assistance. However, some patients do not have any independent mobility and rely completely upon their wheelchairs for support of their bodies.

As patients employing the use of wheelchairs are in a sitting position for long periods of time, it is of the utmost importance that the wheelchair be comfortable and provide ample support for the patient's back, head and neck in order to prevent further injury to the spinal cord and muscles. This is of particular importance for patients who, due to lack of mental ability or muscle strength in the neck area, cannot hold their head in an upright position without assistance. While many wheelchair designs provide a headrest for the patient's comfort, these designs do not help those patients whose necks wobble uncontrollably and involuntarily from side to side. Additionally, it is important to provide support to the patient's shoulders in conjunction with support of the head. If this is not accomplished, the patient's shoulders and center of gravity can shift sideways, producing unwanted pressure on the patient's neck, especially if the head is restrained by some type of movement-controlling device.

Failure to provide proper support of the head, neck and shoulders of a wheelchair-bound patient can cause numerous physical and emotional problems to the patient. Incorrect posture can cause improper weight distribution, causing skin pressure problems such as sores. Correct posture promotes the efficient functioning of internal organs and also improves the appearance of the user. This improved appearance can produce a more positive self-image for the user, improving the user's mental well-being and quality of life.

Standard wheelchairs offer poor upper body and head support, thus, several attempts have been made at making wheelchair add ons. These inventions have been aimed at customizing standard wheelchairs to add the structural support required to maintain correct upper posture while the occupant is seated.

U.S. Pat. No. 5,308,028 (granted to Kornberg) shows a concave headrest support consisting of a horizontal member attached to a pair of slide-adjustable clamping blocks which are attached to the rear of a wheelchair seat by means of vertical members. The headrest can be adjusted vertically and horizontally, and by means of the slide-adjustable clamping blocks, can be rotated clockwise or counterclockwise to adjust to the patient's size and support needs. However, this apparatus provides no support for the patient's shoulders and therefore, offers no ability to keep the patient's body in an upright position should the patient be unable to do so himself.

U.S. Pat. No. 4,989,836 (granted to Hudson, III et al.) also shows a removable apparatus which can be attached to a wheelchair to provide support for the patient's head. This is accomplished by the use of two head supports, located on each side of the patient's head, to prevent the head from involuntarily moving from side to side, and a large strap placed across the patient's forehead to prevent forward movement. While this apparatus accomplishes its objective, to keep the patient's head from moving involuntarily, it does not provide any support for the patient's shoulders. If the patient's shoulders shift sideways while his head is restrained in such a manner, neck strain or injury may occur.

From the foregoing discussion, it can be clearly seen that it would be highly desirable to provide a means for securing both the head and shoulders of a wheelchair-bound patient in a way that prevents unwanted movement and promotes proper posture. Additionally, it is desirable to provide a method for securing the head and shoulders of a wheelchair user that is removable from the wheelchair, and can be adjusted for use by persons with varying heights and shoulder widths.

SUMMARY OF THE INVENTION

It is the primary objective of the present invention to provide a means for supporting both the head and shoulders of a wheelchair-bound patient in a way that prevents unwanted movement and promotes proper posture.

It is a further objective of the present invention to provide a method for securing the head and shoulders of a wheelchair user that can be adjusted for use by persons with varying heights and shoulder widths.

It is still a further objective of the present invention to provide a devise that is inexpensive and adjustable to fit various styles of existing wheelchairs, such that the user can adapt such device for use with existing equipment.

These objectives are accomplished by providing a fully adjustable upper torso and head support positioning system that retro fits to nearly any standard wheelchair. Two individually adjustable lateral pads provide comfortable yet positive adjustable support to fit the unique contours of a wide variety of users. An integrated head support adjusts vertically to an individual's height, and adjusts horizontally to accommodate a moderate to severe kyphosis. The present invention transforms a standard wheelchair into a low cost positioning chair in minutes, at a fraction of the cost of a custom positioning chair. More specifically, the wheelchair support and attachment system is comprised of a head support that is adjustable in both its vertical and horizontal planes, in relation to a wheelchair and shoulder supports which can be adjusted to vary in distance along their horizontal plane. The head and shoulder support adjustments facilitate the present invention's use for patients with varying heights and shoulder widths. The aforementioned head and shoulder supports are attached to a mounting bracket which is designed in a manner that facilitates its easy attachment to the varying designs of wheelchairs currently used today.

For a better understanding of the present invention, reference should be made to the drawings in which there are illustrated and described preferred embodiments of the present invention.

DESCRIPTION OF THE PREFERRED EMBODIMENT

Figure 1:
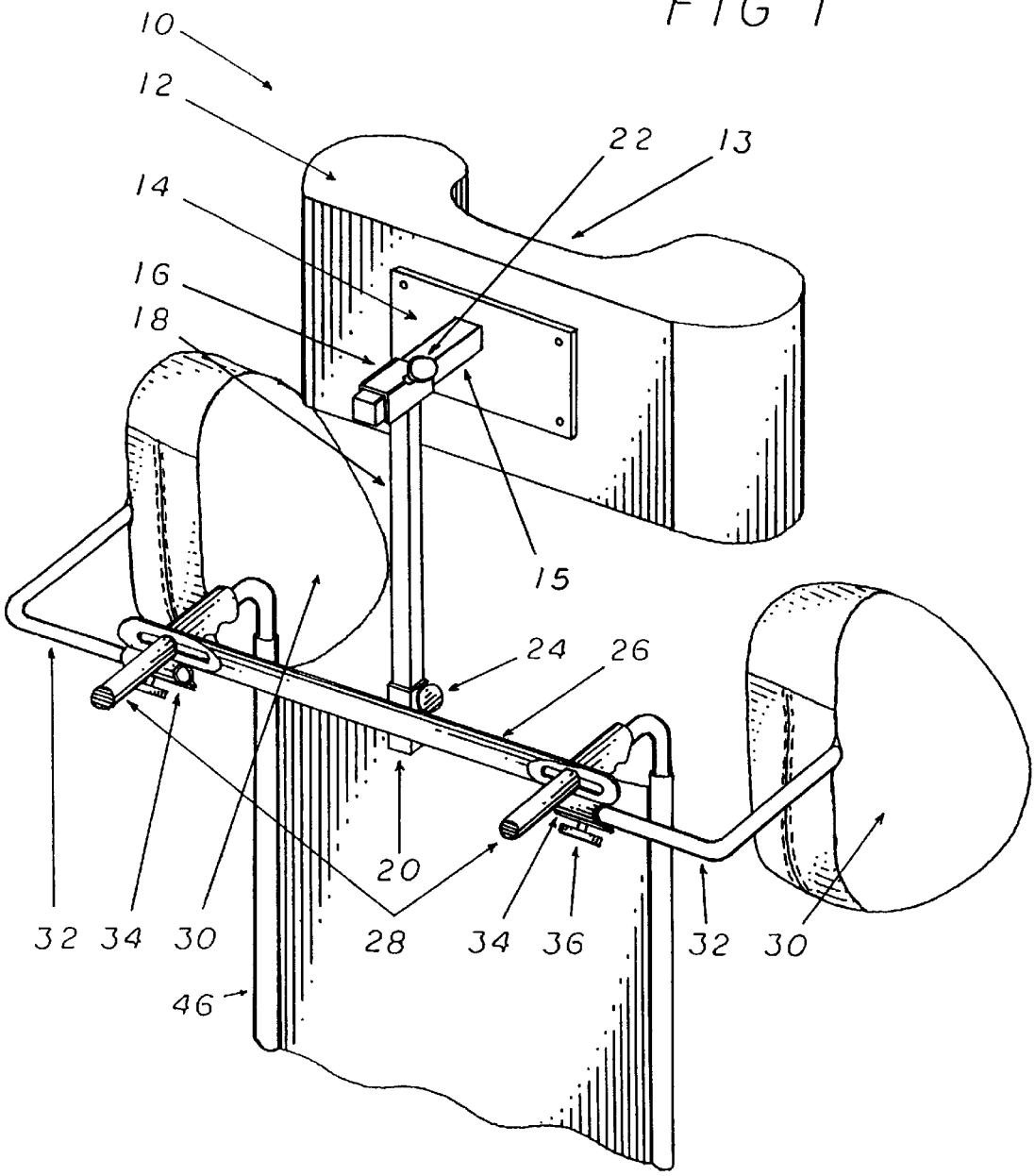
FIG. 1 is a perspective view of the wheelchair support and attachment system showing the orientation of its major components in relation to a typical wheelchair.

Referring now to the drawings, and more specifically to FIGS. 1, 2, 4 and 5, the wheelchair support and attachment system 10 comprises a head support 12, whose primary function is to provide support to a user's head by means of the head support indentation 13, which is a concave indentation in the front portion of the headrest, into which the user's head rests. The other primary component of the present invention is the shoulder support system which provides lateral support for a user's upper body through the shoulders. These components are adjustably attached to the cross member 26 which is in turn capable of being mounted on most common wheelchairs 46 in use today.

This head support 12 is held in a suspended position above the wheelchair 46 by use of the head support bar 18. The head support bar 18 has attached to it at its upper most end the head support horizontal adjustment tube 16. The head support horizontal bar 15, which is attached to and extends rearward from the head support 12, fits inside of the head support horizontal adjustment tube 16 and can be secured at any point along its length by tightening the threaded horizontal adjustment knob 22, which passes through the horizontal adjustment tube 16 and engages the head support horizontal bar 15, thereby locking the head support 12 in the desired position. This configuration allows the head support 12 to be adjusted in the horizontal plane in relation to the wheelchair back 48 depending upon the specific needs of the user.

The head support bar 18 is attached at its lower end to the cross member 26 by use of the head support vertical adjustment tube 20. This component is much the same by means of construction as the head support horizontal adjustment tube 16 in that the head support bar 18 fits inside of it and is held in the desired position by the use of the threaded vertical adjustment knob 24, which again passes through the head support vertical adjustment tube 20 and engages the head support bar 18 in the desired position. This configuration allows the height of the head support 12 to be varied in relation to the wheelchair back 48 to compensate for varying heights of users.

Figure 3:
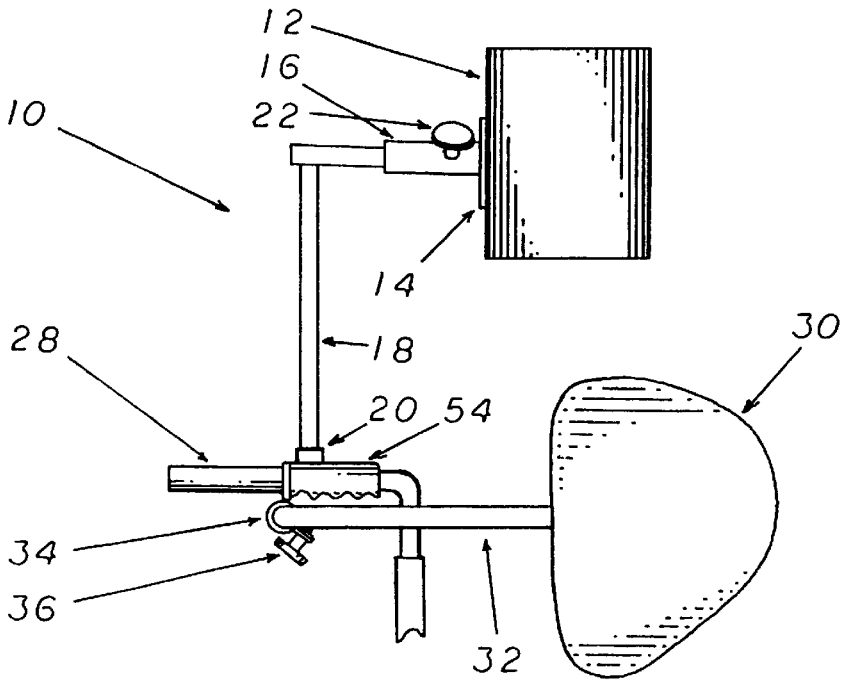
FIG. 3 is a side elevation view of the present invention showing the orientation of the headrest in relation to the shoulder supports as well as an alternative embodiment of a headrest mounting system.
Figure 4:
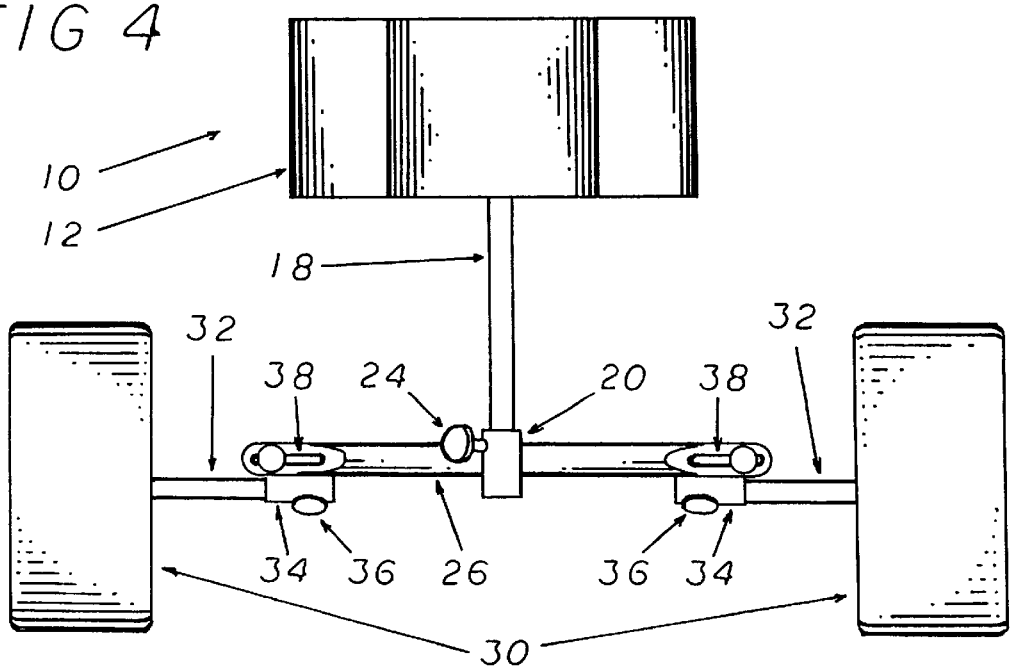
FIG. 4 is a front elevation view of the present invention showing the orientation of the headrest in relation to the shoulder supports of the present invention.
Figure 5:
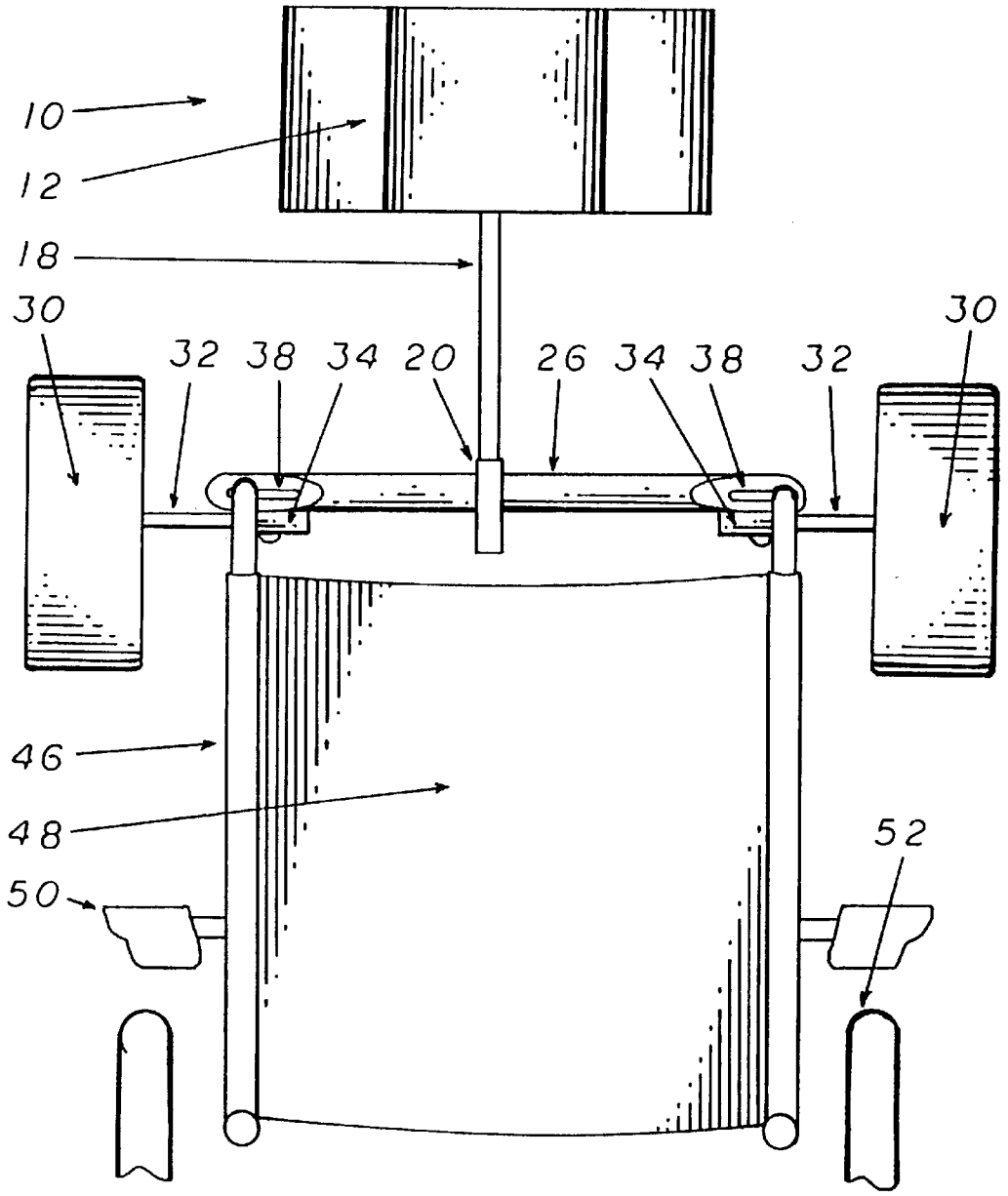
FIG. 5 is a front elevation view of the present invention showing its orientation when mounted onto a typical wheelchair.

In an alternative embodiment of the present invention, as shown by FIG. 3, the head support bar 18 is an L-shaped arm having the horizontal, short portion of said arm attached to the head support attachment plate 14, which is in turn attached to the back of the head support 12 by means of the head support horizontal adjustment tube 16. The head support bar 18 is attached to the head support horizontal adjustment tube 16 by means of the threaded horizontal adjustment knob 22. The head support bar 18 fits inside of the head support horizontal adjustment tube 16 and can be secured at any point along the shorter L-shaped portion of the head support bar 18 by tightening the threaded horizontal adjustment knob 22, which passes through the horizontal adjustment tube 16 and engages the head support bar 18, thereby locking the head support 12 in the desired position. This configuration also allows the head support 12 to be adjusted in the horizontal plane in relation to the wheelchair back 48 depending upon the specific needs of the user but is slightly more limited in the horizontal adjustment plane.

Additionally, FIGS. 1, 2, 3, 4, and 5 detail how the wheelchair support and attachment system 10 provides lateral support to the user's shoulders by the use of the shoulder supports 30. The shoulder supports 30 extend outward and forward in a manner so that they are parallel to one another on either side of the wheelchair back 48, above the wheelchair arms 50 and wheelchair wheels 52, and below the head support 12. The shoulder supports 30 are fixed in their position by the use of the shoulder support bars 32 which are L-shaped and extend through the shoulder support adjustment tubes 34, mounted on either outside end of the cross member 26. The distance between the shoulder supports 30 can be varied by loosening the threaded shoulder support bar adjustment knobs 36 and sliding the shoulder support bars 32 within the shoulder support bar adjustment tubes 34. When the desired distance is obtained, the shoulder support bars 32 can be locked into place by tightening the threaded support bar adjustment knobs 36. This configuration allows the present invention to be adjusted to accommodate users with varying shoulder widths.

The wheelchair support and attachment system 10 is attached to the typical wheelchair 46 by use the cross member 26, which has at either end the wheelchair handle width adjustment slots 38. The cross member 26 is placed in a position so that the wheelchair handle width adjustment slots 38 correspond to the ends of the wheelchair handles 54. This is an important feature of the present invention as it allows for its use with wheelchairs 46 of varying designs and handle bar 54 widths. The cross member 26 is held in place by the use of the threaded handle extensions 28 which pass through it and into the wheelchair handles 54. As described above, the cross member 26 provides the structural basis upon which the head support 12 and the shoulder supports 30 are attached to and held in their desired positions.

Figure 2:
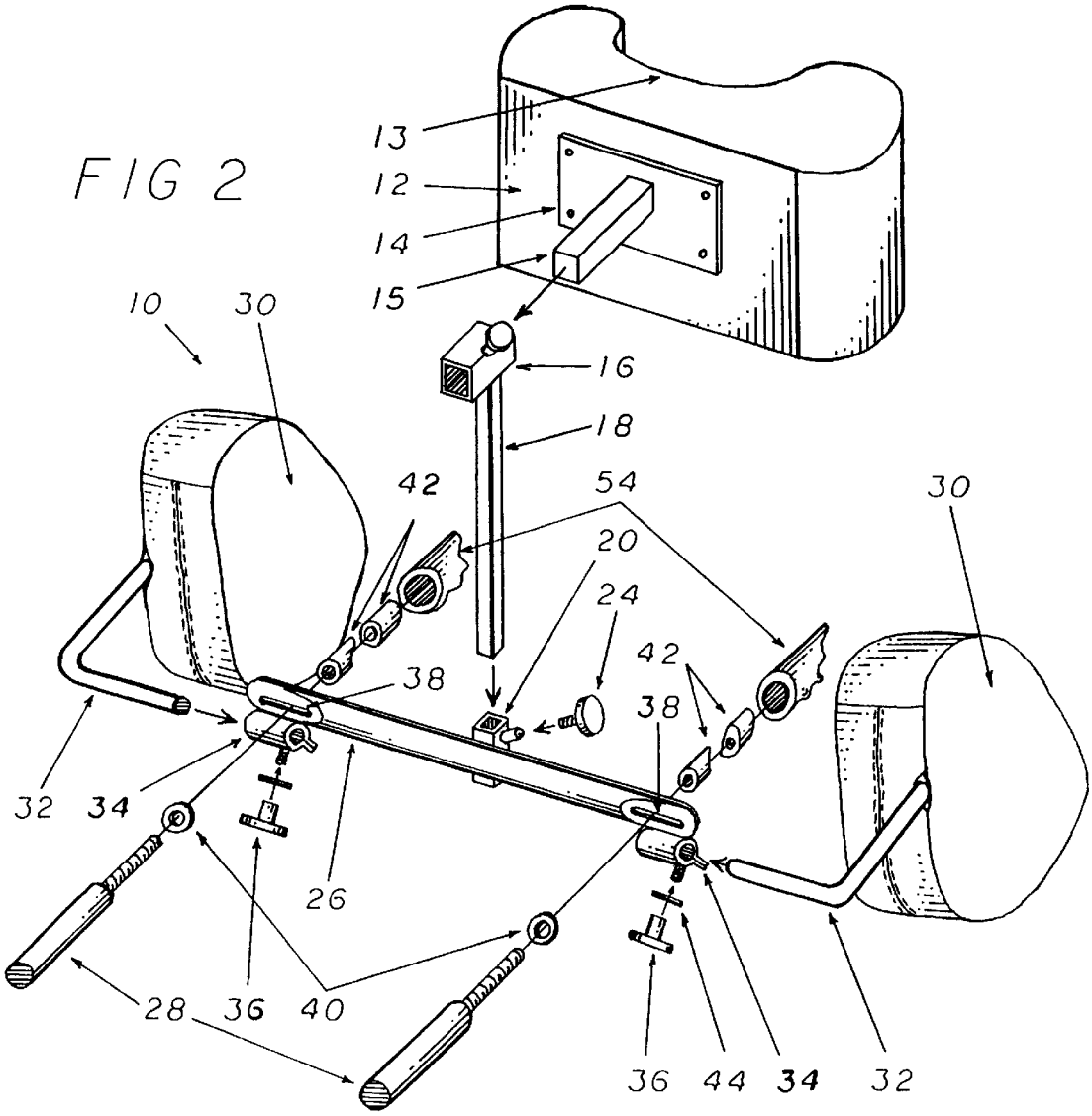
FIG. 2 is an exploded perspective view of the present invention showing the manner in which its parts fit together to form the present invention.

FIG. 2 details the manner of construction of the wheelchair support and attachment means 10 and shows the manner in which the support is attached to a typical wheelchair 46. Specifically, this figure shows the manner in which the shoulder support bars 32 fit within the shoulder support bar adjustment tubes 34 and are held in place by the threaded shoulder support adjustment knobs 36 and the shoulder support knob washers 44, thus providing adjustment for the shoulder supports 30. Additionally, this figure details the manner in which the head support bar 18 fits within the head support horizontal adjustment tube 16 and the head support vertical adjustment tube 20 and is held in place by the threaded horizontal adjustment knob and the threaded vertical adjustment knob, 22 and 24 respectively, thus providing horizontal and vertical adjustment for the head support 12.

FIG. 2 also illustrates how the tubular expansion locks 42 fit within the wheelchair handles 54 and facilitate the attachment of the present invention to a typical wheelchair 46. The tubular expansion locks 42 are two-piece components which are internally threaded and have a matching beveled surface on their respective inner ends. After passing through the extension washers 40 and the wheelchair handle width adjustment slots 38, located on the cross member 26, the threaded handle extensions 28, which replace the wheelchair handles 54, engage the internal threads of the tubular expansion locks 42. As more rotational force is applied to the threaded handle extensions 28, the two pieces of the tubular expansion locks 42 are drawn together and forced to expand because of the beveled surface, thereby locking them into place within the wheelchair handles 54. This configuration provides a secure attachment of the present invention to a typical wheelchair 46.

Although the present invention has been described in considerable detail with reference to certain preferred versions thereof, other versions are possible. Therefore, the spirit and scope of the appended claims should not be limited to the description of the preferred versions contained herein.

What is claimed is:

1. A wheelchair occupant support and attachment system for use on a wheelchair having a back portion with left and right rearwardly extending hollow wheelchair handles having an open rear end, said wheelchair occupant support and attachment system comprising:

a cross member adapted for extending from said left rearwardly extending wheelchair handle to said right rearwardly extending wheelchair handle;

left and right means adapted for attaching said cross member to said left and right rearwardly extending wheelchair handles with said left and right means attaching to said open rear end of said hollow wheelchair handles by extending internally inside said rear end of said hollow wheelchair handles;

left and right shoulder support cushions positioned so as to support an occupant's shoulder area, each of said cushions having left and right rearward extending shoulder support bars and a means of adjustably attaching said left and said right shoulder support bars to said cross member.

2. A wheelchair occupant support and attachment system as in claim 1 further comprising:

a head support;

a head support bar system adjustably attached to said head support; and a means of adjustably attaching said head support bar system to said cross member.

3. A wheelchair occupant support and attachment system as in claim 2 wherein said means of attaching said cross member into said wheelchair handle is a pair of tubular expansion locks for locking into the handles of said wheelchair.

4. A wheelchair occupant support and attachment system as in claim 3 further comprising a left and right wheelchair handle extension that connects said cross member to said tubular expansion locks.

5. A wheelchair head and shoulder support system for use on a wheelchair having a back portion with left and right rearwardly extending hollow wheelchair handles having an open rear end, said wheelchair head and shoulder support system comprising:

a cross member adapted to extend from said left wheelchair handle to said right wheelchair handle;

left and right expansion locks being removably fixed in the open rear end of said hollow wheelchair handle, so as to extend internally into said open rear end of said handle and removably lock in position;

a means of removably attaching said cross member from said left to said right tubular expansion lock;

left and right shoulder support cushions, wherein each of said cushions having a rearward extending shoulder support bar;

a means of adjustably attaching said left and said right shoulder support bars to said cross member;

a head support; and a means of connecting said head support to said cross member.

6. A wheelchair head and shoulder support system as in claim 5 wherein said means of attaching said cross member to said tubular expansion locks comprising left and right wheelchair handle extensions.

7. A wheelchair head and shoulder support system as in claim 6 wherein said means of connecting said head support to said cross member comprises a horizontal bar connected to said head support and an adjustable head support bar having an adjustment tube for slidably connecting to said horizontal bar.

8. A wheelchair head and shoulder support system as in claim 6 wherein said means of connecting said support to said cross member comprises a horizontal adjustment tube connected to said head support and a vertically adjustable head support bar having a horizontal bar fixedly attached to said vertically adjustable head support bar so as to slidably connect with said horizontal adjustment tube.

* * * * *